US006247665B1

(12) United States Patent
Lauderbaugh

(10) Patent No.: US 6,247,665 B1
(45) Date of Patent: Jun. 19, 2001

(54) NUDGING DEVICE

(75) Inventor: David Lauderbaugh, Roswell, GA (US)

(73) Assignee: Corrugated Gear & Services, Alpharetta, GA (US)

( * ) Notice: Subject to any disclaimer, the term of this patent is extended or adjusted under 35 U.S.C. 154(b) by 0 days.

(21) Appl. No.: 09/339,437

(22) Filed: Jun. 24, 1999

(51) Int. Cl.[7] ..... B65H 19/12

(52) U.S. Cl. ..... 242/559.1; 254/38; 254/93 HP; 414/911

(58) Field of Search ..... 242/559, 559.1, 242/559.3, 559.4, 560.2, 560.3, 564.5, 919; 254/38, 93 HP, 93 H; 414/911

(56) References Cited

U.S. PATENT DOCUMENTS

| | | | | |
|---|---|---|---|---|
| 739,017 | | 9/1903 | Miller | 254/38 |
| 830,912 | | 9/1906 | Muehr | 254/38 |
| 1,340,523 | * | 5/1920 | Chapman | 254/38 |
| 1,530,437 | | 3/1925 | Sullivan | 254/38 |
| 1,591,597 | * | 7/1926 | Williamson | 242/559.1 |
| 1,861,070 | * | 5/1932 | Vermillion et al. | 254/38 |
| 2,283,089 | | 5/1942 | Pfauser | 254/104 |
| 2,677,527 | * | 5/1954 | Miehe | 254/38 |
| 3,074,512 | | 1/1963 | Naur | 188/32 |
| 3,251,313 | | 5/1966 | Nansel | 105/90.2 |
| 4,475,695 | * | 10/1984 | Franks | 242/564.5 |
| 4,838,495 | * | 6/1989 | Murasaki | 242/564.5 |
| 5,802,650 | * | 9/1998 | Massey et al. | 254/93 HP |

OTHER PUBLICATIONS

"The Wedge–It," Serial No. 941,032 delivered Jun. 7, 1994 to MacMillan Bathurst, Winnipeg, Canada; The Energy Corp., 1680 Michigan Ave., Suite 918, Miami Beach, FL 33139.

* cited by examiner

*Primary Examiner*—John M. Jillions
(74) *Attorney, Agent, or Firm*—Michael J. Mehrman; Gardner Groff Mehrman & Josephic, P.C.

(57) ABSTRACT

A nudging device that can be used for aligning the core of a roll of paper with a caliper used for loading the roll into a roll stand. The nudging device has a nudging plate with a pivoted end and a free end. The pivoted end of the nudging plate is pivotally attached to a base by a pivot. The base can be securely maintained stationary with respect to a surface supporting a roll of paper to be nudged. The nudging device also has a means for pivoting the nudging plate from its resting position, and this means may be a pneumatic actuator (such as an air bladder), a hydraulic actuator, a ball screw actuator, or a pawl and ratchet actuator. The pivot is strategically placed on the base so that as the nudging plate is pivoted from its resting position, the free end of the nudging plate travels through an arc in a first circular direction (e.g., clockwise) while causing the roll to be nudged away from the nudging device as the roll moves in a second circular direction (e.g., counterclockwise) that is opposite from the first circular direction. The nudging device can also be used for nudging other objects besides rolls of paper. The present invention further provides a method for nudging a roll of paper for manufacturing corrugated board into alignment with a caliper that involves activating the means for pivoting the nudging plate after placing the nudging device in close proximity to the roll.

12 Claims, 2 Drawing Sheets

NUDGING DEVICE

TECHNICAL FIELD

The invention relates generally to the corrugated board manufacturing industry, and, more specifically, to a device for nudging a roll of paper used for manufacturing corrugated board into alignment with a caliper used for loading the roll into a roll stand.

BACKGROUND OF THE INVENTION

Corrugated board manufacturers often use a paper roll having a hollow core as a starting material. These rolls are usually placed on a loading plate that supports the paper roll as it rests on the ground. A caliper inserted into the hollow core of the paper roll then lifts the paper roll off the ground and places it into a roll stand. The paper is then fed into a machine for manufacturing corrugated board.

Before the caliper can be inserted into the hollow core of the paper roll, the core must be aligned with the caliper. However, the paper rolls used to manufacture the corrugated board may vary in thickness, so the core of the paper roll is not always aligned with the caliper. Hence, it is often necessary to slightly adjust the position of the paper roll in order to line up the core with the caliper. As a typical paper roll is large and may weigh several tons, it can be difficult to manually manipulate the position of the roll, even if only a few inches of adjustment are required.

To align the core of the paper roll with the caliper, a power-assisted device can be used to nudge the paper roll. A known device 100 for doing this is shown in FIG. 1. The device 100 has a wedge-shaped base 270 with a rubber grip surface 140 on the bottom that is intended to securely maintain the device stationary with respect to the ground as it nudges the paper roll 295. A nudging plate 240, having a free end 210 and a pivoted end 220, is pivotally attached to the base 270 by the pivoted end. The pivot 230 attaching the nudging plate 240 to the base 270 is positioned at the lower end of the base. A hydraulic or pneumatic actuator (not shown) is located inside the base 270. The actuator exerts a force on the nudging plate 240 in order to cause the nudging plate to pivot. As the nudging plate 240 pivots, the nudging plate in turn exerts a force on the paper roll 295 that causes the paper roll to roll away from the device 100.

As shown in FIG. 1, the pivot 230 in the known device 100 is positioned in such a way that the free end 210 of the nudging plate 240 travels through an arc in a counterclockwise direction. It is important to recognize that this configuration also causes the paper roll 295 to rotate in the same counterclockwise direction as the free end 210 of the nudging plate 240 when the paper roll moves away from the device 100 due to the force exerted on it by the nudging plate.

This configuration of the known nudging device 100 has several negative consequences. One negative consequence is that the friction created by having the free end 210 of the nudging plate 240 travel through an arc in the same circular direction as the paper roll 295 rotates frequently causes the paper comprising the surface of the paper roll to be damaged. Another negative consequence of this configuration of the known device 100 is that it tends to shoot backward, away from the paper roll 295, when the nudging plate 240 exerts force on the paper roll. This tendency to shoot backward occurs despite the rubber grip surface 140 on the bottom of the base 270 and reduces the ability of the device to effectively nudge the roll 295.

Thus, there is a need in the art for an improved nudging device that would decrease damage to the paper comprising the surface of the paper roll while effectively nudging the roll without slipping backward.

SUMMARY OF THE INVENTION

The present invention is an improved nudging device that can be used for aligning the core of a roll of paper with a caliper used for loading the roll into a roll stand. Through a unique configuration of its parts, and in particular the location of a pivot, the nudging device can nudge a roll of paper without damaging the paper. Furthermore, the location of the pivot and the use of a securing means prevents the nudging device from slipping backward as it nudges the roll.

The nudging device has a base and a nudging plate, which has a pivoted end and a free end. The pivoted end of the nudging plate is pivotally attached to the base by a pivot. The base can be securely maintained stationary with respect to a surface supporting a roll of paper to be nudged using a high-friction surface on the base or a bolt mount and bolt. The nudging device also has a means for pivoting the nudging plate from its resting position, and this means may be a pneumatic actuator (such as an air bladder), a hydraulic actuator, a ball screw actuator, a pawl and ratchet actuator, or another suitable type of actuator. The pivot is strategically placed on the base so that as the nudging plate is pivoted from its resting position, the free end of the nudging plate travels through an arc in a first circular direction (e.g., clockwise) while exerting a force on the roll that causes the roll to be nudged away from the nudging device as it moves in a second circular direction (e.g., counterclockwise) that is opposite from the first circular direction. The nudging device can also be used for nudging other objects besides rolls of paper, such as large pipes, railroad cars, and so forth.

The present invention also provides a method for nudging a roll of paper for manufacturing corrugated board into alignment with a caliper for loading the roll into a roll stand. The roll is first positioned adjacent to the caliper. Then, a nudging device as described above is positioned on a surface adjacent to the roll. While the nudging device is securely maintained stationary with respect to the surface, the means for pivoting the nudging plate is activated in order to cause the free end of the nudging plate to travel through an arc in a first circular direction. The free end of the nudging plate thereby nudges the roll in a second circular direction that is opposite to the first circular direction. This nudging is continued until the core of the roll is aligned with the caliper.

The various aspects of the present invention may be more clearly understood and appreciated from a review of the following detailed description of the disclosed embodiments and by reference to the appended drawings and claims.

DETAILED DESCRIPTION OF THE EXEMPLARY EMBODIMENTS

An exemplary embodiment of the present invention is a nudging device that can be used, for example, for aligning the core of a roll of paper with a caliper used for loading the roll into a roll stand. The nudging device has a nudging plate with a pivoted end and a free end. The pivoted end of the nudging plate is pivotally attached to a base by a pivot. The base can be securely maintained stationary with respect to a surface supporting a roll of paper to be nudged. The nudging device also has a means for pivoting the nudging plate from its resting position, and this means may be a pneumatic actuator (such as an air bladder), a hydraulic actuator, a ball screw actuator, or a pawl and ratchet actuator. The pivot is strategically placed on the base so that as the nudging plate is pivoted from its resting position, the free end of the nudging plate travels through an arc in a first circular direction (e.g., clockwise) while causing the roll to be nudged away from the nudging device as the roll moves in a second circular direction (e.g., counterclockwise) that is opposite from the first circular direction. The nudging device can also be used for nudging other objects besides rolls of paper, such as large pipes, railroad cars, and so forth. The present invention further provides a method for nudging a roll of paper for manufacturing corrugated board into alignment with a caliper that involves activating the means for pivoting the nudging plate after placing the nudging device in close proximity to the roll.

Turning now to the drawings, in which like numerals reference like elements throughout the several figures, an exemplary embodiment for implementing the present invention is described.

Figure 1:
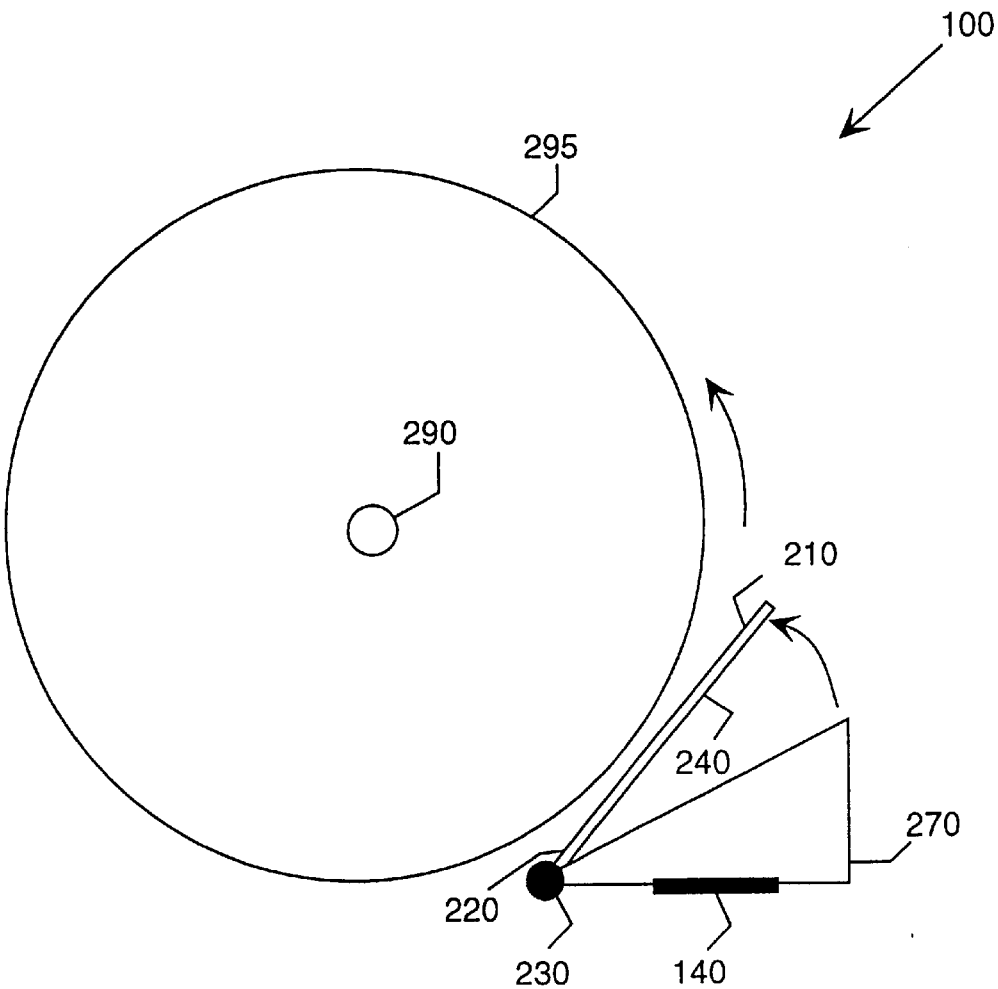
FIG. 1 (PRIOR ART)
FIG. 1 is a side view of a prior art nudging device which causes a roll which is nudged to rotate in the same circular direction as the free end of the nudging plate.
Figure 2A:
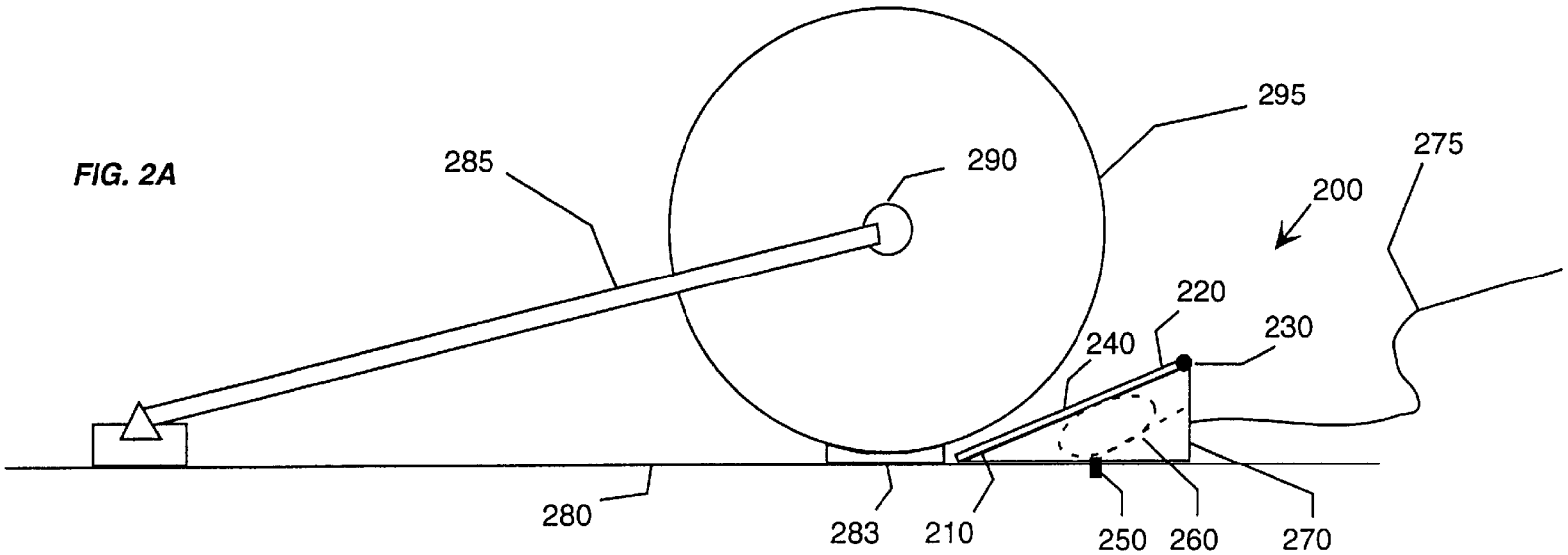
FIG. 2A is a side view of an improved nudging device which causes a roll which is nudged to rotate in a circular direction that is opposite to that of the free end of the nudging plate.

FIG. 2A shows an exemplary nudging device 200 illustrating the present invention. The nudging device is shown adjacent to a roll of paper 295 having a hollow core 290. The roll 295 can be used to manufacture corrugated board. The roll 295 is shown resting on a surface 280 and supported by a loading plate 283. A caliper 285 can lift the roll off the loading plate 283 after it is inserted into the core 290 of the roll. The caliper 285 can then place the roll 295 into the roll stand of a machine (not shown) for manufacturing corrugated board from the roll. In order to insert the caliper 285 into the core 290 of the roll 295, however, the core must be aligned with the caliper. This alignment is preferably accomplished by nudging the roll 295 with the nudging device 200.

The nudging device has a base 270, which is shown to be wedgeshaped in the diagram, but can be any shape that allows the nudging device to have the features that will be described. The nudging device includes a means 250 for securely maintaining the base 270 stationary with respect to the surface 280. For example, the means 250 for securely maintaining the base 270 stationary may include a bolt mount affixed to the base and a bolt affixing the base to the surface 280. Alternatively, the means 250 for securely maintaining the base 270 stationary may include a high-friction surface, such as a rubber grip surface, affixed to the base and which can be placed in contact with the surface 280. Other means 250 for securely maintaining the base 270 stationary with respect to the surface 280, such as a stop bolted to the floor, an indentation in the floor for receiving the base 270, and the like, will occur to one skilled in the art.

A nudging plate 240, having a free end 210 and a pivoted end 220, is pivotally attached the base 270 at the pivoted end. The nudging plate 240 can be pivotally attached to the base 270 by a conventional linear hinge 230. There are numerous types of pivots that can be used for the pivot 230, and they will not be discussed further because they are well known in the mechanical arts.

A key feature of the exemplary nudging device 200 is that the pivot 230 is placed on the base 270 in a location that allows the free end 210 of the nudging plate 240 to travel through an arc in a first circular direction while causing an object, such as the roll 295, with which it is in contact to move in a second circular direction that is the opposite of the first circular direction. The first circular direction is either clockwise or counterclockwise. In other words, if the free end 210 of the nudging plate 240 travels through an arc in a counterclockwise direction, then the nudging plate causes an object with which it is in contact to roll in a clockwise direction. On the other hand, if the free end 210 of the nudging plate 240 travels through an arc in a clockwise direction, then the nudging plate causes an object with which it is in contact to roll in a counterclockwise direction.

Figure 2B:
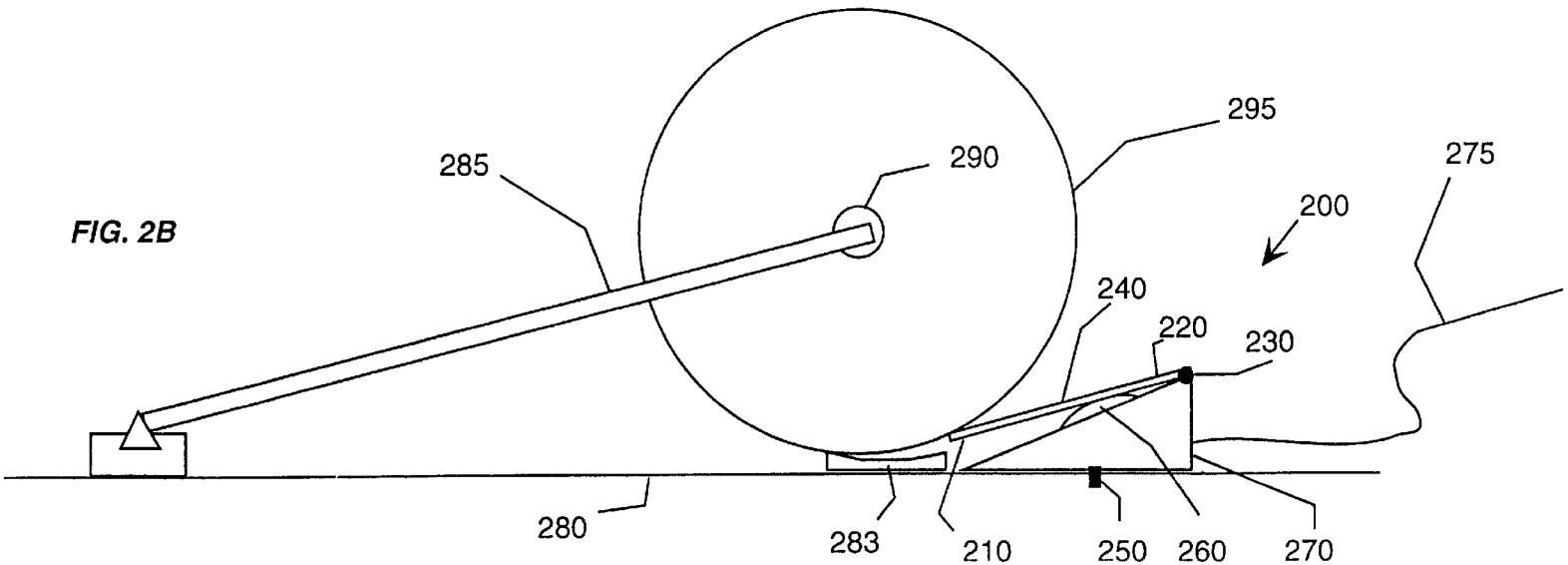
FIG. 2B is a side view of the improved nudging device in operation.

This latter situation is the case in FIG. 2A, and can be clarified with reference to FIG. 2B. FIG. 2B shows the same setup as FIG. 2A. While the nudging plate 240 is in a resting position in FIG. 2A, however, FIG. 2B shows the nudging plate after it has been pivoted to come into contact with the roll 295. A comparison of FIG. 2A and FIG. 2B shows that the location of the pivot 230 causes the free end 210 of the nudging plate 240 to travel in an arc in a clockwise direction as the nudging plate pivots from its resting position. As the free end 210 of the nudging plate 240 travels in the clockwise direction, the nudging plate causes the roll 295 to roll in a counterclockwise direction.

The nudging device also comprises a means for pivoting the nudging plate from its resting position. The means for pivoting the nudging plate may be a pneumatic actuator, a hydraulic actuator, a ball screw actuator, or a pawl and ratchet actuator. The means for pivoting the nudging plate is shown in FIGS. 2A and 2B as a pneumatic actuator comprising an air bladder 260 inside the base 270 and a supply line 275 for delivering compressed air to the air bladder. As compressed air is delivered to the air bladder 260, the air bladder expands, thereby exerting pressure against the nudging plate 240 that causes the nudging plate to pivot. FIG. 2B shows an expanded air bladder 260.

In FIGS. 2A and 2B, the nudging device is not necessarily drawn to scale. The size of the nudging device relative to the roll 295 can be altered so long as the free end 210 of the nudging plate 240 travels through an arc in a first circular direction while causing the roll 295 with which it is in contact to move in a second circular direction that is the opposite of the first circular direction. As a paper roll 295 is typically very large, the nudging device is typically much smaller than the roll it is nudging.

One skilled in the art should recognize that the nudging device could be used for nudging objects other than paper rolls. For example, the nudging device could be used for nudging other substantially cylindrical objects, such as large pipes, railroad cars, and so forth. The nudging device could also be used for nudging or tipping non-cylindrical objects, such as heavy boxes, steel beams, and the like.

The present invention also provides a method for nudging a roll of paper for manufacturing corrugated board into alignment with a caliper for loading the roll into a roll stand. The roll is first positioned adjacent to the caliper. Then, a nudging device as described in FIG. 2A, FIG. 2B, and the accompanying text is positioned on a surface adjacent to the roll. While the nudging device is securely maintained stationary with respect to the surface, the means for pivoting the nudging plate is activated in order to cause the free end of the nudging plate to travel through an arc in a first circular direction. The free end of the nudging plate thereby nudges the roll in a second circular direction that is opposite to the first circular direction. This nudging is continued until the core of the roll is aligned with the caliper.

Other alternative embodiments will become apparent to those skilled in the art to which an exemplary embodiment pertains without departing from its spirit and scope. Accordingly, the scope of the present invention is defined by the appended claims rather than the foregoing description.

What is claimed is:

1. A method for nudging an item into a desired position, comprising the steps of:

positioning a nudging device adjacent to the item, the nudging device comprising:

a wedge-shaped base having a narrow end and a wide end, the base defining a cavity, a nudging plate having a free end and a pivoted end that is pivotally connected to the base closer to the wide end than to the narrow end, the nudging plate being positioned at least partially over the cavity to form a selectively openable junction between the nudging plate and the base, and an actuator positioned within the cavity and between a portion of the base and the nudging plate; and activating the actuator to cause the free end of the nudging plate to travel away from the narrow end of the base to nudge the item.

2. The method of claim 1, wherein:

the step of positioning a nudging device comprises the step of positioning a nudging device comprising an air bladder; and the step of activating the actuator comprises the step of inflating the air bladder.

3. The method of claim 2, further comprising the step of securing the base of the nudging device to prevent movement of the base while the nudging device nudges the item.

4. The method of claim 3, wherein the step of securing the base comprises the step of positioning a high-friction material between the base and a surface supporting the base.

5. A method for nudging a roll of paper into alignment with a caliper that is operative to grasp a core of the roll, comprising the steps of:

positioning the roll of paper adjacent to the caliper;

positioning a nudging device adjacent to the roll of paper, the nudging device comprising:

a wedge-shaped base having a narrow end and a wide end, the base defining a cavity, a nudging plate having a free end and a pivoted end that is pivotally connected to the base closer to the wide end than to the narrow end, the nudging plate being positioned at least partially over the cavity to form a selectively openable junction between the nudging plate and the base, and an actuator positioned within the cavity and between a portion the base and the nudging plate; and activating the actuator to cause the free end of the nudging plate to travel away from the narrow end of the base to nudge the roll of paper into alignment with the caliper; and closing the caliper to grasp the core of the roll.

6. The method of claim 5, wherein:

the step of positioning a nudging device comprises the step of positioning a nudging device comprising an air bladder; and the step of activating the actuator comprises the step of inflating the air bladder.

7. The method of claim 6, further comprising the step of using the caliper to lift the roll of paper into a roll stand.

8. The method of claim 7, further comprising the step of securing the base of the nudging device to prevent movement of the nudging device when the nudging plate travels in contact with the item.

9. The method of claim 8, wherein the step of securing the base of the nudging device comprises the step of positioning a high-friction material between the base and a surface supporting the base.

10. A nudging device, comprising:

a wedge-shaped base having a narrow end and a wide end, the base defining a cavity;

a nudging plate having a free end and a pivoted end pivotally connected to the base closer to the wide end than to the narrow end;

the nudging plate being positioned at least partially over the cavity to form a selectively openable junction between the nudging plate and the base; and an actuator positioned within the cavity and between the nudging plate and a portion of the base and configured to selectively cause the free end of the nudging plate to pivotally travel away from the narrow end of the base.

11. The nudging device of claim 10, wherein the actuator comprises an inflatable air bladder.

12. The nudging device of claim 10, wherein the pivoted end of the nudging plate is pivotally connected to the wide end of the base.

* * * * *